US009347234B2

(12) United States Patent
Voss Weyman

(10) Patent No.: US 9,347,234 B2
(45) Date of Patent: May 24, 2016

(54) POOL SKIMMER BASKET ASSEMBLY WITH ADAPTER

(71) Applicant: Sara Voss Weyman, San Antonio, TX (US)

(72) Inventor: Sara Voss Weyman, San Antonio, TX (US)

(73) Assignee: GVT, Inc., Antonio, TX (US)

( * ) Notice: Subject to any disclaimer, the term of this patent is extended or adjusted under 35 U.S.C. 154(b) by 291 days.

(21) Appl. No.: 13/860,168

(22) Filed: Apr. 10, 2013

(65) Prior Publication Data

US 2014/0263101 A1 Sep. 18, 2014

Related U.S. Application Data

(60) Provisional application No. 61/794,374, filed on Mar. 15, 2013.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.1, 167.19, 232
See application file for complete search history.

(56) References Cited

U.S. PATENT DOCUMENTS

| | | | | |
|---|---|---|---|---|
| 5,830,350 | A * | 11/1998 | Voss et al. | 210/167.12 |
| 6,592,756 | B1 * | 7/2003 | Felix et al. | 210/167.12 |
| 8,647,504 | B2 * | 2/2014 | Vogtner | 210/167.1 |
| 2012/0006730 | A1 * | 1/2012 | Tesauro et al. | 210/87 |

* cited by examiner

*Primary Examiner* — Fred Prince

(57) ABSTRACT

An improved pool skimmer basket assembly with skimmer vent tower adapter for mounting a skimmer vent tower on a pool skimmer basket allows for the existing design of a skimmer vent tower to be retrofitted with any pool skimmer basket and/or any pool skimmer. The adapter is reversibly secured between any pool skimmer basket available on the market and the skimmer vent tower without requiring modifications to either part. Applicant's assembly utilizes the substantially centrally positioned skimmer vent tower of an existing design to provide a means by which water is vented through the basket, even when the strainer orifices are clogged. When the user requires a different size of basket and/or a new basket, he can easily remove the adapter attached to the inner bottom portion of the basket and place it on another basket without forgoing the use of the skimmer vent tower altogether. Ease of removing the adapter and either attaching it to a new basket of the same or a differing size not only prevents additional expense but takes advantage of the skimmer vent tower and, ultimately, all advantages offered by it.

19 Claims, 5 Drawing Sheets

POOL SKIMMER BASKET ASSEMBLY WITH ADAPTER

CROSS-REFERENCE TO RELATED APPLICATIONS/PATENTS

This U.S. Utility application claims priority pursuant to 35 U.S.C. §119(e) to the following U.S. Provisional patent application, the specification of which is incorporated herein by reference for all purposes: U.S. Provisional Application Ser. No. 61/794,374, titled "Improved Pool Skimmer Basket Assembly with Adapter," filed Mar. 15, 2013, pending. The present application relates to U.S. Pat. No. 5,830,350 to Voss et al., titled: POOL SKIMMER BASKET, the disclosure of which is incorporated herein for all purposes.

TECHNICAL FIELD

Applicant's invention relates to filtration devices and more particularly to swimming pool filtration equipment.

BACKGROUND OF THE INVENTION

Most modern swimming pools have circulation and filtration systems, one component of which is known as a "skimmer." A skimmer is a relatively simple structure which involves a skimmer well positioned adjacent to the pool with the top of the well lying slightly below the normal water level of the pool. A conduit (filter opening) extends between the skimmer well wall and the pool wall, and opens, respectively, at points near the top of the skimmer well and near, but just below, the normal water level in the pool.

At the bottom of the skimmer well is an orifice (filter passage) through which water in the skimmer well is drawn in by a vacuum pump and returned to the pool in an endless cycle. Over time, all the water in the pool will pass through the skimmer, and, under ordinary conditions, items floating on top of the water will eventually flow into the skimmer well.

A highly perforated skimmer basket is sized and shaped to sit within the skimmer well and serves as a strainer to trap leaves or other items which flow into the skimmer. An improved pool skimmer basket having vent means which permit continued circulation of water through the pool skimmer basket, even when all filtration perforations are clogged, is subject to U.S. Pat. No. 5,830,350 to Voss et al, wherein the basket, in its preferred embodiment, exhibits a centrally positioned skimmer "vent tower" which extends from the bottom of the basket to a point at least slightly above the upper rim of the basket. This both reduces the likelihood that debris will obstruct all of the vent tower orifices and allows water to exit the vent tower as the basket is withdrawn from the well to facilitate such withdrawal through the access opening while the vacuum pump is in operation.

A frequent problem encountered by pool owners is the variety in sizes and/or constructions of skimmers and, consequently, different sizes of pool skimmer baskets necessary to fit them. This, in turn, causes pool owners to forgo using the existing design of the skimmer vent tower. For instance, if the swimming pool has a different size skimmer and/or requires a different size skimmer basket (than the one disclosed in the U.S. Pat. No. 5,830,350), the pool owner is prevented from utilizing the skimmer vent tower, which leaves him no option but to resort to currently available skimmer baskets without the skimmer vent tower advantage.

Thus, there is a need to use the existing design of the skimmer vent tower as disclosed in the U.S. Pat. No. 5,830,350 on any skimmer basket and/or any skimmer well without requiring modification of either part, thus making the existing design universal.

SUMMARY OF THE INVENTION

It is the object of the present invention to provide an improved pool skimmer basket assembly with skimmer vent tower adapter for mounting the skimmer vent tower on a pool skimmer basket which allows for the existing design of a skimmer vent tower to be retrofitted with any pool skimmer basket and/or any pool skimmer design without requiring modifications to either part.

Another object of the invention is to provide a method of separating and removing debris entrained in pool water passing from a pool through a filter passage communicating with a filter opening formed in a wall of the pool, said method comprising the steps of: selecting a skimmer pool basket, said basket sized and shaped for nesting reception within a pool skimmer well, said skimmer basket having a basket bottom portion and the basket peripheral wall portion, said basket bottom portion having an inner bottom portion and an outer bottom portion, said basket peripheral portion extending upwardly from the periphery of said basket bottom portion and terminating as a basket side portion rim, said basket bottom portion and said peripheral wall portion of the skimmer basket defining therein a plurality of perforations in the form of a grid; attaching a skimmer vent tower to said basket by utilizing a skimmer vent tower adapter, said adapter reversibly mounted on said inner bottom portion of said basket; locating said pool skimmer basket in a filter passage; and grasping the handle of said basket and removing the basket outwardly from the filter passage through the access opening for emptying the captured debris from the basket.

In satisfaction of these and related objectives, Applicant's present invention provides an improved pool skimmer basket assembly comprising: a pool skimmer basket sized and shaped for nesting reception within a pool skimmer well, said skimmer basket having a basket bottom portion and the basket peripheral wall portion, said basket bottom portion having an inner bottom portion and an outer bottom portion, said basket peripheral portion extending upwardly from the periphery of said basket bottom portion and terminating as a basket side portion rim, said basket bottom portion and said peripheral wall portion of the skimmer basket defining therein a plurality of perforations in the form of a grid; a skimmer vent tower, said skimmer vent tower threadably engaged with an inner surface of a threaded skimmer vent tower adapter, said skimmer vent tower adapter substantially centrally and reversibly attached to an inner bottom portion of a pool skimmer basket by plurality of attachment means, said attachment means secured by plurality of securing means for securing said skimmer vent tower adapter to an inner bottom portion of a pool skimmer basket.

In its preferred embodiment, the skimmer vent adapter comprises a plurality of openings configured to receive a plurality of attachment means for securely attaching said skimmer vent adapter to said inner bottom portion of the pool skimmer basket, said plurality of attachment means further configured to receive a plurality of securing means for securing said skimmer vent adapter to the pool skimmer basket.

Furthermore, Applicant's invention provides in combination a pool skimmer basket and a reversibly attached skimmer vent tower adapter configured to allow a skimmer vent tower to be utilized with said pool skimmer basket of any size and/or design.

Applicant's pool skimmer basket assembly, in its preferred embodiment, exhibits a substantially centrally positioned skimmer vent tower which extends from the adapter to a point at least slightly above the upper rim of the basket. The skimmer vent tower is a hollow structure with small perforations or vent orifices dispersed along its length. At least one such vent orifice must reside slightly above the level of the upper rim of the basket to insure that an orifice lies above the water level in the skimmer well. This both reduces the likelihood that debris will obstruct all of the vent tower orifices and allows water to exit the vent tower as the basket is withdrawn from the well to facilitate such withdrawal.

Further, the Applicant's invention provides a pool skimmer adapter assembly, comprising a skimmer vent tower, said skimmer vent tower threadably engaged with an inner surface of a threaded skimmer vent tower adapter, said skimmer vent tower adapter substantially centrally and reversibly attached to an inner bottom portion of a pool skimmer basket by plurality of attachment means, said attachment means secured by plurality of securing means for securing said skimmer vent tower adapter to an inner bottom portion of a pool skimmer basket.

The skimmer vent tower is reversibly attached to the pool skimmer basket through a skimmer vent tower adapter, whereby an open lower end of the skimmer vent tower (the outer external mounting feature/exterior profile) is threadably engaged with the inner surface of the skimmer vent tower adapter, wherein said inner surface of said skimmer vent tower adapter makes conformal contact all along its inner surface with the exterior profile of the skimmer vent tower, and the bottom part of the skimmer vent tower adapter is in direct contact with but reversibly attached to the inner bottom portion of the basket through the attachment means, thus, allowing the skimmer vent tower to be reversibly attached to any size of the skimmer basket.

Because there are multiple sizes of swimming pools skimmers and, consequently, skimmer baskets utilized in pool filtration systems, use of the skimmer vent tower adapter greatly enhances the utility of the skimmer vent tower and the improved pool skimmer basket as substantially described in the U.S. Pat. No. 5,830,350.

Applicant's approach to the problem described above is certainly simple, but it is equally unobvious. Applicant's informal surveys of pool owners reveal a dire need for skimmer vent tower adapters to be used with different pool skimmers so a skimmer vent tower can be utilized with practically any design of skimmer and/or skimmer basket. This, in turn, will alleviate the pervasive problem of broken skimmer baskets (which were broken when straining against the suction of the pool's vacuum pump when the basket was clogged) and the often resulting unpleasant experience of "fishing" the basket out of the skimmer well. Despite this well-known and long-existing problem, and a readily apparent market for a solution, no one has presented a viable, cost-effective solution such as Applicant here provides.

The principals of the invention will be further discussed with reference to the drawing(s) wherein a preferred embodiment is shown. The specifics illustrated in the drawings are intended to exemplify, rather than limit aspects of the invention as defined in the claims.

BRIEF DESCRIPTION OF THE DRAWINGS

For a more complete understanding, reference is now made to the following description taken in conjunction with the accompanying drawings in which.

DETAILED DESCRIPTION

Figure 1:
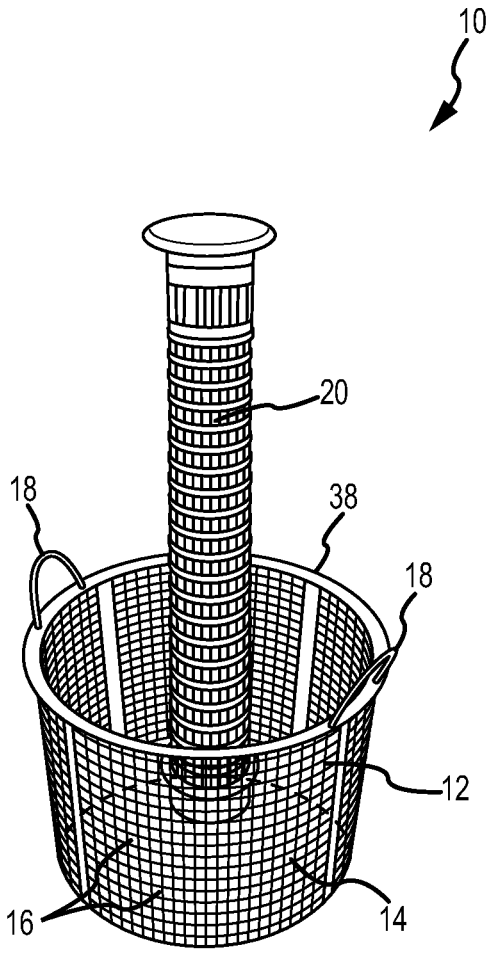
FIG. 1 is a perspective view of the preferred embodiment of Applicant's improved pool skimmer basket assembly with adapter.

Referring to FIG. 1, Applicant's improved pool skimmer basket assembly with adapter is identified generally by the reference numeral 10. While most baskets 10 are unitary structures, for discussion purposes, basket 10 can be divided into two primary portions—the peripheral wall or side portion 12 and a bottom portion 14. Both side portion 12 and bottom portion 14 are perforated by numerous strainer orifices (perforations in a form of a grid) 16. As with any skimmer basket, strainer orifices 16 allow water as drawn through the pool skimmer (FIG. 6) to pass through the basket 10, but catch most solids in a strainer-like manner. Basket 10 is removed from a skimmer well using a handle (not shown) which is connected to handle eyes 18.

Figure 2:
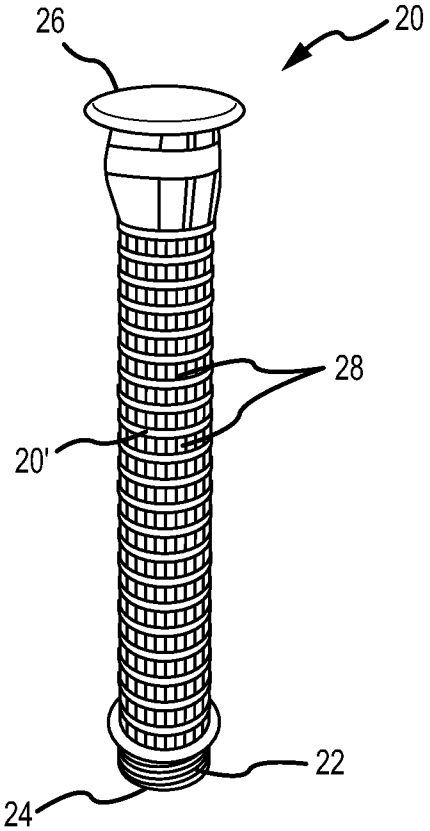
FIG. 2 is an elevational view of the skimmer vent tower of the improved pool skimmer basket assembly of FIG. 1 according to one embodiment of the present invention.

Referring to FIGS. 1 and 2, extending upwardly into the interior space of basket 10 from the inner bottom portion 40 (FIG. 4) is a vent tower 20. Vent tower 20 is a hollow structure formed of an elongate vent body 20' having a first vent tower end, which includes a threaded annulus (the outer external mounting feature for screwing into a threaded hole of a skimmer vent tower adapter 30) 22 at its bottom end 24, said bottom end 24 of vent tower 20 opens into the interior hollow of vent tower 20, and a second vent tower end 26, said vent tower 20 defining within said vent body 20' and between said first vent tower end 22 and said second vent tower end 26, a vent tower interior hollow, said vent body 20' having one or more vent orifices 28 extending through said vent body between said vent tower interior hollow and space exterior to said vent tower, at least one of said vent orifices being positioned, whereby, when said first vent tower end is connected with said basket bottom portion 14 through said adapter 30, said at least one said vent orifice resides at a point lying at a greater linear distance from said basket bottom portion 14 than said basket side portion rim 38 resides from said basket bottom portion 14 when measured in parallel with the longitudinal axis of said vent tower, said first end of said vent tower having an exit orifice 24 which opens to said interior hollow.

Vent tower 20, in the preferred embodiment, is threadingly engaged with skimmer vent tower adapter 30 (FIG. 3) at a threaded inner portion (or surface) 32 of the skimmer vent tower adapter 30. Of course, any other engagement schemes between the skimmer vent tower and the skimmer vent tower adapter, including bayoneted mounts, snap-fit structures, etc. will suffice.

As stated above, vent tower 20 is highly perforated with a number of vent orifices 28. According to one embodiment of the present invention, the top of the second vent tower end 26 may have at least one orifice (not shown). Vent tower 20 should be of a length that it extends above the level of the basket rim 38, and at least some of the skimmer vent tower orifices 28 should be positioned whereby, they will be above the level of the basket rim 38 when engaged with the skimmer basket 10. The basis for this is discussed above in the Summary of the Invention as well as in the disclosure of U.S. Pat. No. 5,830,350.

In the preferred embodiment, the skimmer vent tower 20 is removable from basket 10 for allowing the use of certain skimmer accessories (pool sweeper attachments, most notably) which require a flush mating between a plate member and the basket rim 38 of the basket 10, which mating the vent tower 20 would likely obstruct if left in place.

The over-all substantially cylindrical shape of vent tower 20 as shown in the drawings is merely the preferred embodiment—the result of molding efficiencies. Any structure of any shape which provide fluid communication through a plurality of vent orifices between space interior to basket 10 (other than as are positioned on the side portion 12 or bottom portion 14 of basket 10) and space outside of basket 10 will satisfy the functional requirements of vent tower 20.

Figure 3A:
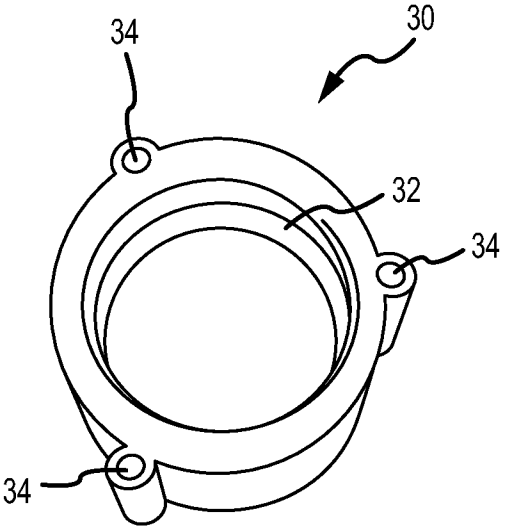
FIG. 3A is a perspective view of the threaded adapter according to preferred embodiment of Applicant's improved pool skimmer basket assembly of FIG. 1.
Figure 3C:
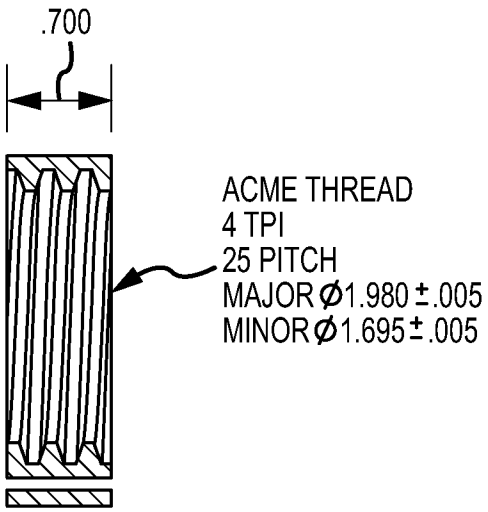
FIG. 3C is a section view of the inner surface of the treaded skimmer vent tower adapter with indications of exemplary physical dimensions according to one embodiment of the present invention.
Figure 3B:
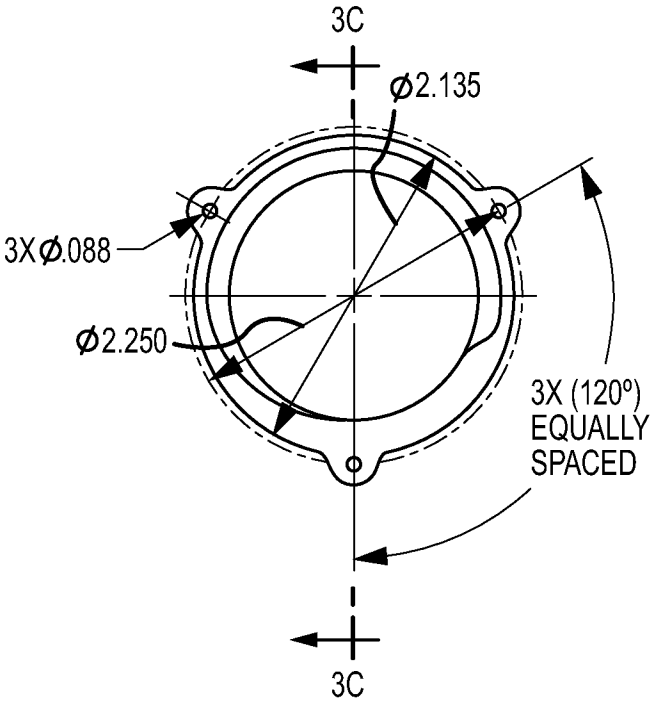
FIG. 3B is a cross-sectional view of the threaded skimmer vent tower adapter with indications of exemplary physical dimensions according to one embodiment of the present invention.
Figure 4:
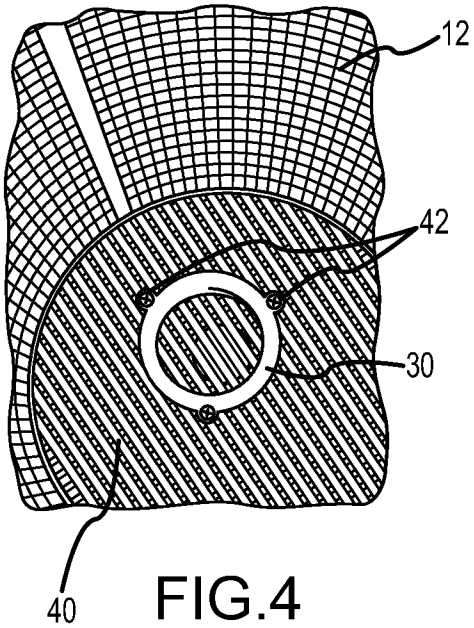
FIG. 4 is a perspective view of the inside bottom of the skimmer basket showing the skimmer vent tower adapter substantially centrally and reversibly attached to the inner bottom portion of the skimmer basket according to one embodiment of the present invention.

Referring now to FIGS. 3 and 4, the skimmer vent tower adapter 30 comprises an inner, threadable surface 32 configured to match the exterior threadable profile 22 of the skimmer vent tower 20 and plurality of openings 34 for receiving attachment means 42 such as screws or pins for securely, yet reversibly attaching the skimmer vent tower adapter 30 to the inner bottom portion 40 of the skimmer basket 10. Of course, any other reversible engagement schemes between the skimmer vent tower adapter and the inner bottom portion of the skimmer basket, including bayoneted mounts, snap-fit structures, etc. will suffice.

Figure 5:
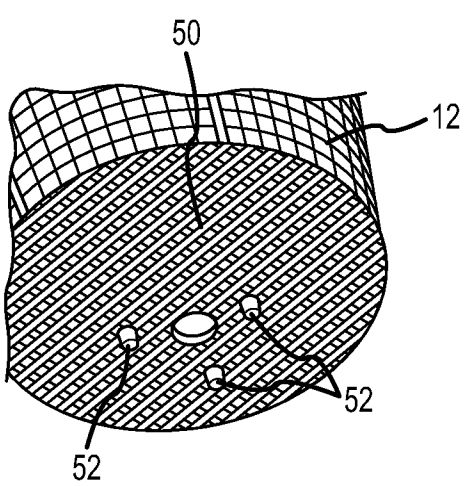
FIG. 5 is a perspective view of the outside bottom of the skimmer basket showing the securing means receiving the attachment means for attaching the skimmer vent tower adapter according to one embodiments of the present invention.

Referring now to FIGS. 4 and 5, the skimmer vent tower adapter 30 is substantially centrally and reversibly attached to the inner bottom portion 40 of the skimmer basket 10 through a plurality of attachment means 42, which are further secured (received) by the securing means 52 (e.g. cap nuts) mounted on the attachment means 42 from the outer bottom portion 50 of the skimmer basket 10.

Figure 6:
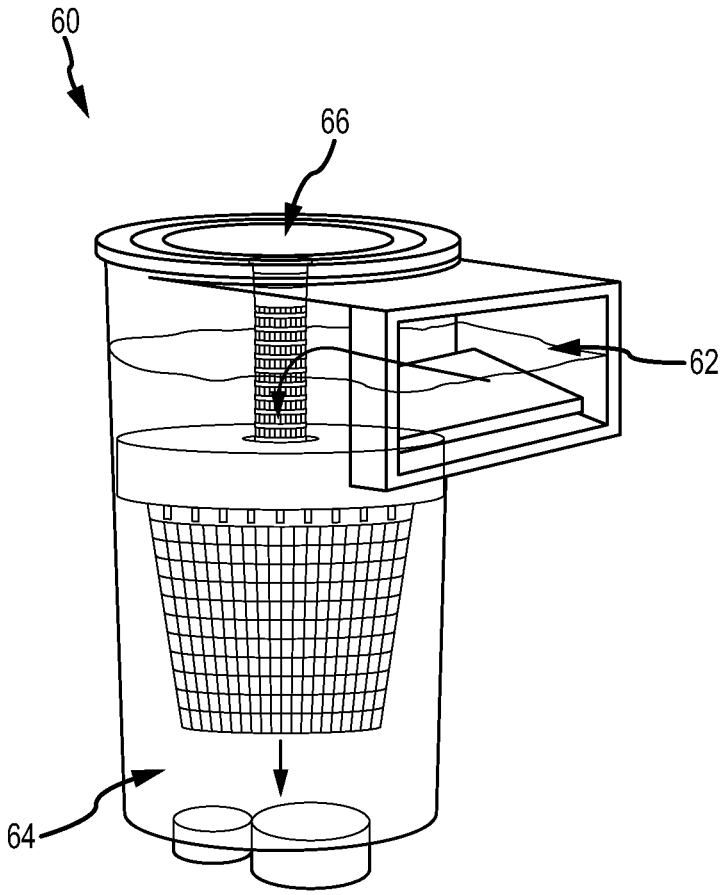
FIG. 6 is an exemplary elevational view of the skimmer well filtration system with an improved pool skimmer basket positioned inside according to the method described herein.

Referring now to FIG. 6, a skimmer well 60 is positioned adjacent to the pool with the top of the well lying slightly below the normal water level of the pool. A conduit (filter opening) 62 extends between the skimmer well wall and the pool wall, and opens, respectively, at points near the top of the skimmer well and near, but just below the normal water level in the pool.

At the bottom of the skimmer well is an orifice (filter passage) 64 through which water in the skimmer well is drawn by vacuum pump, which water is returned to the pool in an endless cycle. Over time, all the water in the pool will pass through the skimmer, and, under ordinary conditions, items floating on top of the water will eventually flow into the skimmer well and the skimmer basket 10.

A highly perforated skimmer basket 10 is sized and shaped to sit within the skimmer well 60 and serves as a strainer to trap leaves or other items which flow into the skimmer. The basket could be emptied by lifting it upwardly through the accesses opening 66.

Although the invention has been described with reference to specific embodiments, this description is not meant to be construed in a limited sense. Various modifications of the disclosed embodiments as well as alternative embodiments of the inventions will become apparent to persons skilled in the art upon the reference to the description of the invention. It is, therefore, contemplated that the appended claims will cover such modifications that fall within the scope of the invention.

What is claimed is:

1. A pool skimmer adapter assembly, comprising:

a skimmer vent tower adapter, said skimmer vent tower adapter attached to an inner bottom portion of a pool skimmer basket by attachment means for attaching said skimmer vent tower adapter to said inner bottom portion of said pool skimmer basket; and a skimmer vent tower, said skimmer vent tower having a mounting feature for engaging with said skimmer vent tower adapter, wherein said skimmer vent tower is formed of an elongate vent body having a first vent tower end and a second vent tower end, said vent tower defining within said vent body and between said first vent tower end and said second vent tower end, a vent tower interior hollow, said vent body having a first vent orifice extending through said vent body between said vent tower interior hollow and space exterior to said vent tower, said first vent orifice being positioned, whereby, when said first vent tower end is connected with said skimmer vent tower adapter, said first vent orifice resides at a point lying at a greater linear distance from said basket bottom portion than said basket side portion rim resides from said basket bottom portion when measured in parallel with the longitudinal axis of said vent tower, said first end of said vent tower having an exit orifice which opens to said interior hollow.

2. The pool skimmer adapter assembly of claim 1, wherein said first vent orifice has an aperture defining an opening that is at least one-twelfth in square measurement units of the surface area, in like said measurement units of the outer surface area of said vent tower that resides beyond any point that is at a greater linear distance from said basket bottom portion than said basket side portion rim resides from said basket bottom portion, when measured in parallel with the longitudinal axis of said vent tower.

3. The pool skimmer adapter assembly of claim 1, further comprising a second said vent orifice positioned at a greater linear distance from said basket bottom portion than said basket side portion rim resides from said basket bottom portion when measured in parallel with the longitudinal axis of said vent tower.

4. The pool skimmer adapter assembly of claim 3, wherein said first and second vent orifices together define an opening of a size that is at least one-twelfth in square measurement units of the surface area, in like said measurement units of said vent tower that resides beyond any point that is at a greater linear distance from said basket bottom portion than said basket side portion rim resides from said basket bottom portion, when measured in parallel with the longitudinal axis of said vent tower.

5. The pool skimmer adapter assembly of claim 1, wherein said skimmer vent tower adapter further comprises a plurality of openings for receiving said attachment means.

6. The pool skimmer adapter assembly of claim 1, further comprising securing means for securing said skimmer vent adapter to said skimmer basket, said securing means configured to be coupled to said attachment means and arranged exterior to said skimmer basket.

7. A pool skimmer basket assembly, comprising:

a pool skimmer basket configured for nesting reception within a pool skimmer well, said skimmer basket having a basket bottom portion and a basket peripheral wall portion, said basket bottom portion having an inner bottom portion and an outer bottom portion, said basket peripheral wall portion extending upwardly from the periphery of said basket bottom portion and terminating as a basket side portion rim, said basket bottom portion and said peripheral wall portion of the skimmer basket defining therein a plurality of perforations;

a skimmer vent tower adapter attached to said inner bottom portion of said pool skimmer basket by attachment means for attaching said skimmer vent tower adapter to said inner bottom portion of said pool skimmer basket; and a skimmer vent tower, said skimmer vent tower having a mounting feature for engaging with said skimmer vent tower adapter, wherein said skimmer vent tower is formed of an elongate vent body having a first vent tower end and a second vent tower end, said vent tower defining within said vent body and between said first vent tower end and said second vent tower end, a vent tower interior hollow, said vent body having a first vent orifice extending through said vent body between said vent tower interior hollow and space exterior to said vent tower, said first vent orifice being positioned, whereby, when said first vent tower end is connected with said skimmer vent tower adapter, said first vent orifice resides at a point lying at a greater linear distance from said basket bottom portion than said basket side portion rim resides from said basket bottom portion when measured in parallel with the longitudinal axis of said vent tower, said first end of said vent tower having an exit orifice which opens to said interior hollow.

8. The pool skimmer adapter assembly of claim 7, wherein said first vent orifice has an aperture defining an opening of a size that is at least one-twelfth in square measurement units of the surface area, in like said measurement units of said vent tower that resides beyond any point that is at a greater linear distance from said basket bottom portion than said basket side portion rim resides from said basket bottom portion, when measured in parallel with the longitudinal axis of said vent tower.

9. The pool skimmer basket assembly of claim 7, further comprising a second said vent orifice positioned at a greater linear distance from said basket bottom portion than said basket side portion rim resides from said basket bottom portion when measured in parallel with the longitudinal axis of said vent tower.

10. The pool skimmer adapter assembly of claim 9, wherein said first and second vent orifices together define an opening of a size that is at least one-twelfth in square measurement units of the surface area, in like said measurement units of said vent tower that resides beyond any point that is at a greater linear distance from said basket bottom portion than said basket side portion rim resides from said basket bottom portion, when measured in parallel with the longitudinal axis of said vent tower.

11. The pool skimmer adapter assembly of claim 7, wherein said skimmer vent tower adapter further comprises a plurality of openings for receiving said attachment means.

12. The pool skimmer adapter assembly of claim 7, further comprising securing means for securing said skimmer vent adapter to said skimmer basket, said securing means configured to be coupled to said attachment means and arranged exterior to said skimmer basket.

13. A method of separating and removing debris entrained in pool water passing from a pool through a filter passage communicating with a filter opening formed in a wall of the pool, said method comprising the steps of:

attaching a pool skimmer vent tower adapter to an inner bottom portion of a pool skimmer basket by attachment means for attaching said skimmer vent tower adapter to said inner bottom portion of said pool skimmer basket;

engaging a skimmer vent tower to said vent tower adapter via a mounting feature of said vent tower, wherein said skimmer vent tower is formed of an elongate vent body having a first vent tower end and a second vent tower end, said vent tower defining within said vent body and between said first vent tower end and said second vent tower end, a vent tower interior hollow, said vent body having a first vent orifice extending through said vent body between said vent tower interior hollow and space exterior to said vent tower, said first vent orifice being positioned, whereby, when said first vent tower end is connected with said skimmer vent tower adapter, said first vent orifice resides at a point lying at a greater linear distance from said basket bottom portion than said basket side portion rim resides from said basket bottom portion when measured in parallel with the longitudinal axis of said vent tower, said first end of said vent tower having an exit orifice which opens to said interior hollow; and enabling at least partial relief of a pool pump pressure with said first vent orifice when said skimmer basket has debris trapped therein.

14. The method of claim 13, wherein said first vent orifice has an aperture defining an opening that is at least one-twelfth in square measurement units of the surface area, in like said measurement units of the outer surface area of said vent tower that resides beyond any point that is at a greater linear distance from said basket bottom portion than said basket side portion rim resides from said basket bottom portion, when measured in parallel with the longitudinal axis of said vent tower.

15. The method of claim 13, wherein said pool skimmer adapter further comprises a second said vent orifice positioned at a greater linear distance from said basket bottom portion than said basket side portion rim resides from said basket bottom portion when measured in parallel with the longitudinal axis of said vent tower, thereby enabling further pressure relief to said pool pump.

16. The pool skimmer adapter assembly of claim 15, wherein said first and second vent orifices together define an opening of a size that is at least one-twelfth in square measurement units of the surface area, in like said measurement units of said vent tower that resides beyond any point that is at a greater linear distance from said basket bottom portion than said basket side portion rim resides from said basket bottom portion, when measured in parallel with the longitudinal axis of said vent tower.

17. The method of claim 13, further comprising receiving said attachment means with a plurality of openings of said vent tower adapter.

18. The method of claim 13, further comprising receiving said attachment means with securing means for securing said skimmer vent adapter to said skimmer basket, said securing means arranged exterior to said skimmer basket.

19. The method of claim 13, further comprising grasping handles of said pool skimmer basket to remove said pool skimmer basket from a pool skimmer well.

* * * * *